US011371741B2

(12) United States Patent
Maloo et al.

(10) Patent No.: US 11,371,741 B2
(45) Date of Patent: Jun. 28, 2022

(54) AIR CONDITIONING APPARATUS AND METHOD FOR CONTROLLING USING LEARNED SLEEP MODES

(71) Applicant: Samsung Electronics Co., Ltd., Suwon-si (KR)

(72) Inventors: Chandra Ashok Maloo, Suwon-si (KR); Soonhyung Gwon, Seongnam-si (KR); Tan Kim, Suwon-si (KR); Hyungseon Song, Suwon-si (KR); Dongjun Shin, Suwon-si (KR); Hyunwoo Ock, Suwon-si (KR); Minkyong Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/051,575

(22) PCT Filed: May 10, 2019

(86) PCT No.: PCT/KR2019/005675
§ 371 (c)(1),
(2) Date: Oct. 29, 2020

(87) PCT Pub. No.: WO2019/221458
PCT Pub. Date: Nov. 21, 2019

(65) Prior Publication Data

US 2021/0088250 A1 Mar. 25, 2021

(30) Foreign Application Priority Data

May 18, 2018 (KR) ..... 10-2018-0057461

(51) Int. Cl.
*F24F 11/64* (2018.01)
*F24F 11/66* (2018.01)
(Continued)

(52) U.S. Cl.
CPC ..... *F24F 11/64* (2018.01); *F24F 11/66* (2018.01); *F24F 11/30* (2018.01);
(Continued)

(58) Field of Classification Search
CPC ..... G05B 15/02; G05B 2219/2642; G05B 2219/2614; G05B 13/024; F24F 11/30;
(Continued)

(56) References Cited

U.S. PATENT DOCUMENTS 5,282,261 A * 1/1994 Skeirik ..... G05B 13/027 700/44
9,298,197 B2 3/2016 Matsuoka et al.
(Continued)

FOREIGN PATENT DOCUMENTS

JP 2016-522663 A 7/2016
KR 0177723 B1 4/1999
(Continued)

OTHER PUBLICATIONS

Sathyanarayana et al., Sleep Quality Prediction From Wearable Data Using Deep Learning, JMIR Mhealth and Uhealth, Nov. 25, 2016.

*Primary Examiner* — Darrin D Dunn
(74) *Attorney, Agent, or Firm* — Jefferson IP Law, LLP

(57) ABSTRACT

The present disclosure provides an air conditioning apparatus and a method for controlling same. The method for controlling an air conditioning apparatus comprises the steps of: the air conditioning apparatus receiving, from an external server, user sleep information acquired on the basis of data on time for which the air conditioning apparatus is operated in a sleep cooling mode used during the user's sleep; and operating in the cooling mode on the basis of the user sleep information. Specifically, at least part of an operation for acquiring the user sleep information on the basis of the user's control command may use an artificial intelligence
(Continued)

model obtained by learning according to at least one of a machine learning, a neural network, and a deep learning algorithm.

10 Claims, 13 Drawing Sheets

(51) Int. Cl.
*F24F 11/30* (2018.01)
*F24F 110/20* (2018.01)
*F24F 130/10* (2018.01)
*F24F 110/10* (2018.01)

(52) U.S. Cl.
CPC ..... *F24F 2110/10* (2018.01); *F24F 2110/20* (2018.01); *F24F 2130/10* (2018.01)

(58) Field of Classification Search
CPC ..... F24F 2120/20; F24F 11/62; F24F 11/64; F24F 2120/10; F24F 11/66; F24F 11/70
See application file for complete search history.

(56) References Cited

U.S. PATENT DOCUMENTS

| | | | | |
|---|---|---|---|---|
| 10,300,241 | B2 | 5/2019 | Jung et al. | |
| 2019/0078833 | A1* | 3/2019 | Graziano | F25D 29/00 |
| 2019/0200872 | A1* | 7/2019 | Matsuoka | A61B 5/0013 |
| 2020/0034745 | A1* | 1/2020 | Nagpal | G06N 5/022 |
| 2020/0125976 | A1* | 4/2020 | Otano | G06N 3/0454 |
| 2021/0191342 | A1* | 6/2021 | Lee | G05B 13/048 |
| 2021/0374864 | A1* | 12/2021 | Kchouk | G06F 17/18 |

FOREIGN PATENT DOCUMENTS

| | | | |
|---|---|---|---|
| KR | 10-2006-0030765 | A | 4/2006 |
| KR | 10-1670610 | B1 | 10/2016 |
| KR | 10-2016-0145987 | A | 12/2016 |
| KR | 10-2017-0073175 | A | 6/2017 |

* cited by examiner

AIR CONDITIONING APPARATUS AND METHOD FOR CONTROLLING USING LEARNED SLEEP MODES

TECHNICAL FIELD

This disclosure relates to an air conditioning apparatus and a method for controlling thereof and, more particularly to, an air conditioning apparatus which can be operated in a sleep cooling mode without a user's manipulation and a method for controlling thereof.

BACKGROUND ART

An air conditioning apparatus (air conditioner) is a device which is arranged in a space such as a house, an office, a store, and a house for cultivating crops to control the temperature, humidity, cleanliness, and air flow of air, so that an indoor environment suitable for a person living in a pleasant indoor environment or growing crops is maintained.

An air conditioning apparatus includes a sleep cooling mode (sleep mode, etc.) for pleasant sleep and energy saving.

However, in the related art, it is inconvenient for a user to input an operation command to change from a general cooling mode to a sleep cooling mode before bedtime, and to change from a sleep cooling mode to a general cooling mode after the wake-up.

If a user inputs an on/off time of the sleep cooling mode in advance, and the air conditioning apparatus is automatically turned on/off based on the input time, there is a problem in that the user must input the operation command again, due to inconsistency with an actual life pattern of the user.

Accordingly, there is a need for an art to automatically driving a sleep cooling mode suitable for a life pattern of a user.

DISCLOSURE

Technical Problem

The disclosure has been made in view of the above-described needs, and it is an object of the disclosure to provide an air conditioning apparatus and a controlling method thereof, which can operate in a sleep cooling mode according to user sleep tendency without user's manipulation.

Technical Solution

A method for controlling an air conditioning apparatus includes receiving, from an external server, user sleep information obtained based on data on time for which the air conditioning apparatus is operated in a sleep cooling mode used during the user's sleep; and operating in the sleep cooling mode based on the user sleep information.

The air conditioning apparatus may be set to one of a general mode operated by a user's manipulation or an artificial intelligence model operated based on a user's usage history without a user's manipulation, and the method may further include, while the air conditioning apparatus is being set to a general mode, transmitting, to the external server, data on time for which the air conditioning apparatus is operated in the sleep cooling mode by the user's manipulation.

The receiving may include receiving the user sleep information while the air conditioning apparatus is set to an artificial intelligence mode, and the operating may include operating in the sleep cooling mode, while the air conditioning apparatus is set to an artificial intelligence mode.

The user sleep information may be obtained by using an artificial intelligence model included in the external server and the data, and the artificial intelligence model may acquire the user sleep information using a periodic characteristic over time of the data.

The artificial intelligence model may include a Trigonometric Regressors, Box-Cox transformation, ARMA Error, Trend and Seasonality (TBATS) model, and the user sleep information may be obtained based on a periodic characteristic extracted using the TBATS model.

The periodic characteristic over the time may be extracted based on at least one criteria with an hour as an essential element, and a day and a month as selective elements from the data.

Based on an interval where time for which the air conditioning apparatus is not operated in the sleep cooling mode is greater than or equal to a preset value, the user sleep information may be obtained using data in which the data with respect to the interval is deleted and the artificial intelligence model.

The user sleep information may include at least one of a start point in time, an operation time, and end point in time of the sleep cooling mode.

The user sleep information may further include setting information of the sleep cooling mode, and the operating may include operating in the sleep cooling mode based on the set temperature.

An air conditioning apparatus according to an embodiment includes a communicator configured to communicate with an external server; and a processor configured to cause the air conditioning apparatus to receive, through the communicator, user sleep information obtained based on data on time for which the air conditioning apparatus is operated in a sleep cooling mode used during the user's sleep, and operates in the sleep cooling mode based on the user sleep information.

The air conditioning apparatus may be set to one of a general mode operated by a user's manipulation or an artificial intelligence model operated based on a user's usage history without a user's manipulation, and the processor is further configured to, while the air conditioning apparatus is being set to a general mode, transmit, to the external server, data on time for which the air conditioning apparatus is operated in the sleep cooling mode by the user's manipulation.

The processor is further configured to receive the user sleep information while the air conditioning apparatus is set to an artificial intelligence mode, and operate in the sleep cooling mode, while the air conditioning apparatus is set to an artificial intelligence mode.

The user sleep information may be obtained by using an artificial intelligence model included in the external server and the data, and the artificial intelligence model may acquire the user sleep information using a periodic characteristic over time of the data.

The artificial intelligence model may include a Trigonometric Regressors, Box-Cox transformation, ARMA Error, Trend and Seasonality (TBATS) model, and the user sleep information may be obtained based on a periodic characteristic extracted using the TBATS model.

The periodic characteristic over the time may be extracted based on at least one criteria with an hour as an essential element, and a day and a month as selective elements from the data.

Based on an interval where time for which the air conditioning apparatus is not operated in the sleep cooling mode is greater than or equal to a preset value, the user sleep information may be obtained using data in which the data with respect to the interval is deleted and the artificial intelligence model.

The user sleep information may include at least one of a start point in time, an operation time, and end point in time of the sleep cooling mode.

The user sleep information may further include setting information of the sleep cooling mode, and the processor may operate the apparatus in the sleep cooling mode based on the set temperature.

A server according to an embodiment includes a communicator configured to communicate with an air condition apparatus; a memory storing an artificial intelligence model, and a processor configured to cause the air conditioning apparatus to receive user sleep information by inputting data on time for which the air conditioning apparatus is operated in a sleep cooling mode used during the user's sleep, and transmit, through the communicator, the obtained user sleep information to the air conditioning apparatus.

The processor may extract the periodic characteristic over time using a Trigonometric Regressors, Box-Cox transformation, ARMA Error, Trend and Seasonality (TBATS) model, and may obtain the user sleep information by inputting the extracted periodic characteristic to the artificial intelligence model.

BEST MODE FOR CARRYING OUT THE INVENTION

Figure 1:
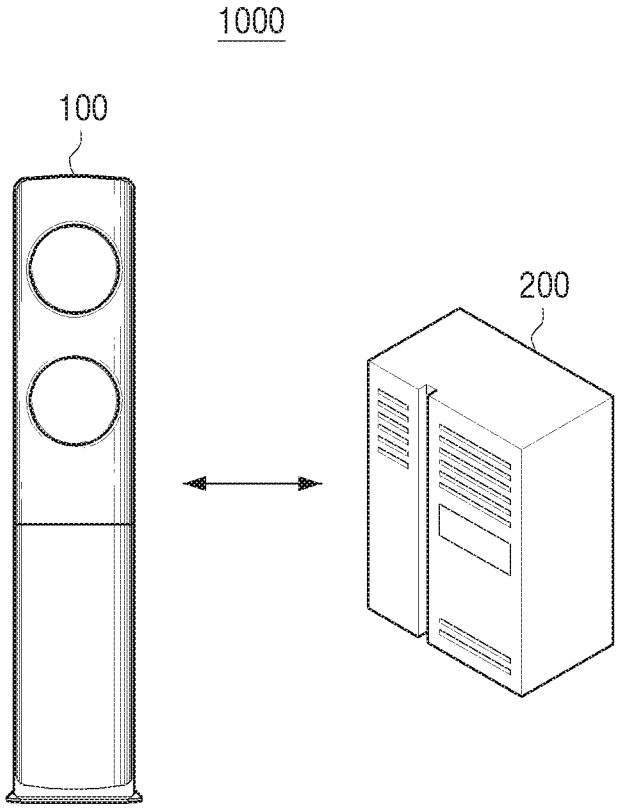
FIG. 1 is a diagram illustrating an air conditioning system according to an embodiment.

After terms used in the present specification are briefly described, the disclosure will be described in detail.

The terms used in the disclosure and the claims are general terms identified in consideration of the functions of the various embodiments of the disclosure. However, these terms may vary depending on intention, technical interpretation, emergence of new technologies, and the like, of those skilled in the related art. Unless a specific definition of a term is provided, the term may be understood based on the overall content and technological understanding of those skilled in the related art.

Since the disclosure may be variously modified and have several embodiments, specific non-limiting example embodiments of the disclosure will be illustrated in the drawings and be described in detail in the detailed description. However, it is to be understood that the disclosure is not limited to specific non-limiting example embodiments, but includes all modifications, equivalents, and substitutions without departing from the scope and spirit of the disclosure. A detailed description of known configurations related to the disclosure may be omitted so as to not obscure the gist of the disclosure.

Terms such as "first," "second," and the like, may be used to describe various components, but the components should not be limited by the terms. The terms are used to distinguish a component from another component.

A singular expression includes a plural expression, unless otherwise specified. It is to be understood that the terms such as "comprise," "comprising," "including," and the like, are used herein to designate a presence of a characteristic, number, step, operation, element, component, or a combination thereof, and do not preclude a presence or a possibility of adding one or more of other characteristics, numbers, steps, operations, elements, components or a combination thereof.

Terms such as "module," "unit," "part," and the like, may be used to refer to an element that performs at least one function or operation, and the element may be implemented as hardware, software, or a combination of hardware and software. Further, except for when each of a plurality of "modules," "units," "parts," and the like, is implemented in an individual hardware, the components may be integrated in at least one module or chip and may be implemented by at least one processor.

Hereinafter, non-limiting embodiments of the disclosure will be described in detail with reference to the accompanying drawings so that those skilled in the art to which the disclosure pertains may easily practice the disclosure. However, the disclosure may be implemented in various different forms and is not limited to embodiments described herein. In addition, in the drawings, portions unrelated to the description will be omitted, and similar portions will be denoted by similar reference numerals throughout the specification.

The disclosure will be described in greater detail with reference to a drawing.

FIG. 1 is a diagram illustrating an air conditioning system according to an embodiment.

Referring to FIG. 1, an air conditioning system 1000 includes an air conditioning apparatus 100 and a server 200.

The air conditioning apparatus 100 performs an operation for conditioning indoor air. Specifically, the air conditioning apparatus 100 may perform at least one of cooling to lower the temperature of the indoor air, heating to increase the temperature of the indoor air, air blowing to form air flow in an indoor space, or dehumidification to lower indoor humidity.

The air conditioning apparatus 100 may include an outdoor unit which exchanges heat with external air by using a refrigerant, and an indoor unit which exchanges the refrigerant with the outdoor unit and performs a conditioning operation of the indoor air. The air conditioning apparatus 100 may refer to an indoor unit capable of performing a controlling operation.

The air conditioning apparatus 100 may operate in a plurality of modes. First, the air conditioning apparatus 100 can operate in one of a general mode operated by a user's manipulation and an artificial intelligence mode operated on the basis of the user's usage history without user's manipulation. Here, the general mode or the artificial intelligence mode may be set by the user's manipulation.

When the air conditioning apparatus 100 is set to a normal mode or an artificial intelligence mode, the air conditioning apparatus 100 may operate in a plurality of cooling modes. Here, the cooling mode may refer to an algorithm in which a setting temperature, a wind direction, and a wind speed, or the like, are input according to a function that can be implemented in the air conditioning apparatus 100.

The cooling mode may include a general cooling mode which operates by a user's operation input. The cooling mode may include a sleep cooling mode which causes the air conditioning apparatus 100 to operate with a preset algorithm while the user is sleeping.

The air conditioning apparatus 100 can transmit and receive data to and from the server 200. Specifically, the air conditioning apparatus 100 may transmit log data for the operation of the air conditioning apparatus 100 to the server 200. Here, the log data may be data in which data for the operation of the user is stored in time series manner Therefore, when the air conditioning apparatus 100 is set to the normal mode, the air conditioning apparatus 100 can transmit the log data for the operation of the air conditioning apparatus 100 to the server 200.

For example, the log data may include a time to turn on a sleep cooling mode, a time to turn off a sleep cooling mode of the air conditioning apparatus 100, setting temperature and setting temperature manipulation time when the air conditioning apparatus 100 operates in the sleep cooling mode, or the like.

The air conditioning apparatus 100 may receive user sleep information from the server 200, and may operate in a sleeping cooling mode based on the received user sleep information. At this time, the air conditioning apparatus 100 may be set to an artificial intelligence mode that operates based on user usage history without user manipulation.

The server 200 may receive the data for the time when the air conditioning apparatus 100 operates in a sleep cooling mode and may obtain the user sleep information based on the received data. Specifically, the server 200 may include an artificial intelligence model, and may input the received data to an artificial intelligence model to obtain user sleep information. Here, the user sleep information may be at least one of a start time of a sleep cooling mode, an operation time of a sleep cooling mode, and an end time of a sleep cooling mode, or the like.

The server 200 may extract a periodic characteristic over time from the received data and input the extracted periodic characteristic to an artificial intelligence model.

AI technology is composed of machine learning, for example deep learning, and elementary technologies that utilize machine learning.

Machine learning is an algorithmic technology that is capable of classifying or learning characteristics of input data. Element technology is a technology that simulates functions, such as recognition and judgment of a human brain, using machine learning algorithms, such as deep learning. Machine learning is composed of technical fields such as linguistic understanding, visual understanding, reasoning, prediction, knowledge representation, motion control, or the like.

Various fields implementing AI technology may include the following. Linguistic understanding is a technology for recognizing, applying, and/or processing human language or characters and includes natural language processing, machine translation, dialogue system, question and answer, speech recognition or synthesis, and the like. Visual understanding is a technique for recognizing and processing objects as human vision, including object recognition, object tracking, image search, human recognition, scene understanding, spatial understanding, image enhancement, and the like. Inference prediction is a technique for judging and logically inferring and predicting information, including knowledge-based and probability-based inference, optimization prediction, preference-based planning, recommendation, or the like. Knowledge representation is a technology for automating human experience information into knowledge data, including knowledge building (data generation or classification), knowledge management (data utilization), or the like. Motion control is a technique for controlling the autonomous running of the vehicle and the motion of the robot, including motion control (navigation, collision, driving), operation control (behavior control), or the like.

For example, the artificial intelligence model may include Trigonometric Regressors, Box-Cox transformation, ARMA Error, Trend and Seasonality (TBATS) model, Box-Cox transformation, ARMA Error, Trend and Seasonality (BATS) model, Multiple error mod, Box-Cox transformation, ARMA Error, Trend and Seasonality (MTBATS) model, or the like, for predicting data based on periodicity.

The user sleep information may further include a set temperature of a sleep cooling mode. Specifically, the server 200 may further receive data on a set temperature of time operated in a sleep cooling mode from the air conditioning apparatus 100, and may be provided with weather information of a time at which the air conditioning apparatus 100 is operated in a sleep cooling mode from an external server providing weather information. Here, the weather information may include temperature, humidity, etc.

The server 200 may identify a user's tendency based on the data received from the external server and the air conditioning apparatus 100. The server 200 may predict a set temperature of the sleep cooling mode based on the tendency of the user, and transmit the predicted set temperature to the air conditioning apparatus 100.

FIG. 1 illustrates that the air conditioning apparatus 100 is a stand type, but in actual implementation, the air conditioning apparatus 100 may be a wall-mounted type, a ceiling-type, a duct-type, a floor-mounted type, or the like, and may perform air-conditioning in a wind-free type according to the wind speed.

As described above, according to the disclosure, even if a user does not input an operation command, an air conditioning apparatus is operated at a sleep cooling mode and a set temperature to be suitable for a user's sleep tendency, thereby improving user convenience.

Figure 2:
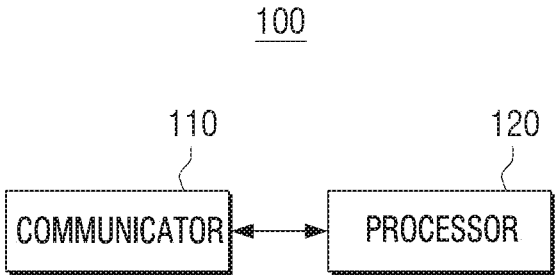
FIG. 2 is a block diagram illustrating a simple configuration of an air condition apparatus according to an embodiment.

FIG. 2 is a block diagram illustrating a simple configuration of an air condition apparatus according to an embodiment.

Referring to FIG. 2, the air conditioning apparatus 100 includes a communicator 110 and a processor 120.

The communicator 110 may communicate with an external server. Here, the external server may be a server for controlling the air conditioning apparatus 100. Specifically, the communicator 110 can transmit the usage log data of the air conditioning apparatus 100 to an external server, and can receive user sleep information from an external server. In addition to the user sleep information, the communicator 110 may receive a control command or the like from an external server of the communicator 110.

The communicator 110 may communicate with an external server providing weather information. The processor 120 may coordinate the air at a preferred temperature and humidity based on the weather information received from the external server.

The communicator 110 may communicate with an external device by a wired or wireless manner.

Specifically, the communicator 110 may be connected to an external device in a wireless manner, such as a wireless local area network (LAN), Bluetooth, or the like. In addition, the communicator 110 may be connected to an external device using Wi-Fi, Zigbee, or Infrared (IrDA). The communicator 110 may include a connection port in a wired manner.

The processor 120 may control overall operations and functions of the air conditioning apparatus 100.

Specifically, if the air conditioning apparatus 100 is set to the general mode operated by the user's manipulation, the processor 120 can transmit the log data for the user's manipulation to the external server through the communicator 110. For example, the processor 120 may transmit data on the time at which the air conditioning apparatus 100 is operated in the sleep cooling mode to the external server according to the user's manipulation. That is, when the air conditioning apparatus 100 is operated in the normal mode, the data that the user controls the air conditioning apparatus 100 may be collected.

If the air conditioning apparatus 100 is set to an artificial intelligence mode operated without user's manipulation, the processor 120 can receive user sleep information from an external server through the communicator 110. Here, the user sleep information received from the external server may be obtained on the basis of the data on the time for which the air conditioning apparatus 100 is operated in the sleep cooling mode used during the user's sleep. For example, the user sleep information may include a user sleep start time, a sleep time, a user wake-up time, or the like. That is, the user sleep information may include at least one of a start time of a sleep cooling mode of the air conditioning apparatus 100, an operation time of a sleep cooling mode, or an end time of a sleep cooling mode.

The processor 120 may operate in a sleep cooling mode based on the received user sleep information. Specifically, the sleep cooling mode may be turned on/off based on the start time, the operation time, and the end time of the sleep cooling mode included in the user sleep information.

It has been described that, if the air conditioning apparatus 100 is set to the normal mode, data is collected, and if the air conditioning apparatus 100 is set to the artificial intelligence mode, the user's sleep information is received from the external server, but in the actual implementation, the data may be collected for a predetermined period of time while the air conditioning apparatus 100 is set to the same mode, and the user sleep information may be received from the external server in a period other than the predetermined period.

The user sleep information can be obtained by using an artificial intelligence model included in the external server and the data, which is transmitted from the air conditioning apparatus 100 to the external device, about the time at which the air conditioning apparatus 100 is operated in a sleep cooling mode. Here, the artificial intelligence model can obtain user sleep information by using a periodic characteristic according to a period of data for a time in which the air conditioning apparatus 100 is operated in a sleep cooling mode. The periodic characteristic according to the period of time may indicate that the data about operating time of the air conditioning apparatus 100 in the sleep cooling mode is analyzed, and the data is extracted based on at least one criterion with an hour as an essential element and a day and a month as selective elements from the data. For example, the periodic characteristic may be obtained with at least one of a time unit, day unit, and a month unit.

This periodic characteristic can be extracted by the TBATS mathematical model included in the artificial intelligence model. Here, the TBATS model is one of models for predicting data based on periodicity, uses a trigonometric function term to catch seasonality, uses the Box-Cox transformation to catch heterogeneity, uses the ARMA error model to catch short-term dynamic motion, uses the trend term to catch the trend, and uses a seasonal term to catch seasons. Here, the term seasonality may refer to a variation phenomenon that is regularly generated due to a climate, a holiday, a vacation, etc., and may be a meaning corresponding to a periodic characteristic. Using the TBATS model described above, more accurate prediction is possible using a small amount of data. In addition to the TBATS model, a similar BATS model or MTAS model can also be used.

If there is an interval in which the air conditioning apparatus 100 not operating in a sleep cooling mode is longer than a predetermined value, for more accurate prediction, user sleep information can be obtained by using the data from which the data about the above interval is deleted and the artificial intelligence model.

For example, according to flow of time, if the time at which the air conditioning apparatus 100 is operated in a sleep cooling mode is substitute to 1, and a time at which the air conditioning apparatus 100 is not operated in a sleep cooling mode is substituted to 0, when there is an interval where the air conditioning apparatus 100 is not operated in the sleep cooling mode for 24 hours more, the interval may be input to an artificial intelligence model to obtain user sleep information. Here, the 24 hours as a reference for data deletion is only one embodiment, and is not limited thereto.

The user sleep information received from the external server through the communicator 110 may further include a set temperature of a sleep cooling mode. Specifically, the processor 120 may further transmit information on a set temperature when the air conditioning apparatus 100 is operated in a sleep cooling mode through the communicator 110. Further, the received user sleep information may further include a set temperature obtained based on information on a set temperature when the air conditioning apparatus 100 is operated in a sleep cooling mode. At this time, the obtained set temperature may be obtained through an artificial intelligence model included in the external server, and may reflect the tendency of the user.

The processor 120 may operate in a sleep cooling mode by reflecting the set temperature included in the received user sleep information.

As described above, according to the disclosure, even if a user does not turn on/off a cooling mode each time, a cooling mode is automatically executed to reflect the tendency of a user, so that the user's convenience can be improved.

Figure 3:
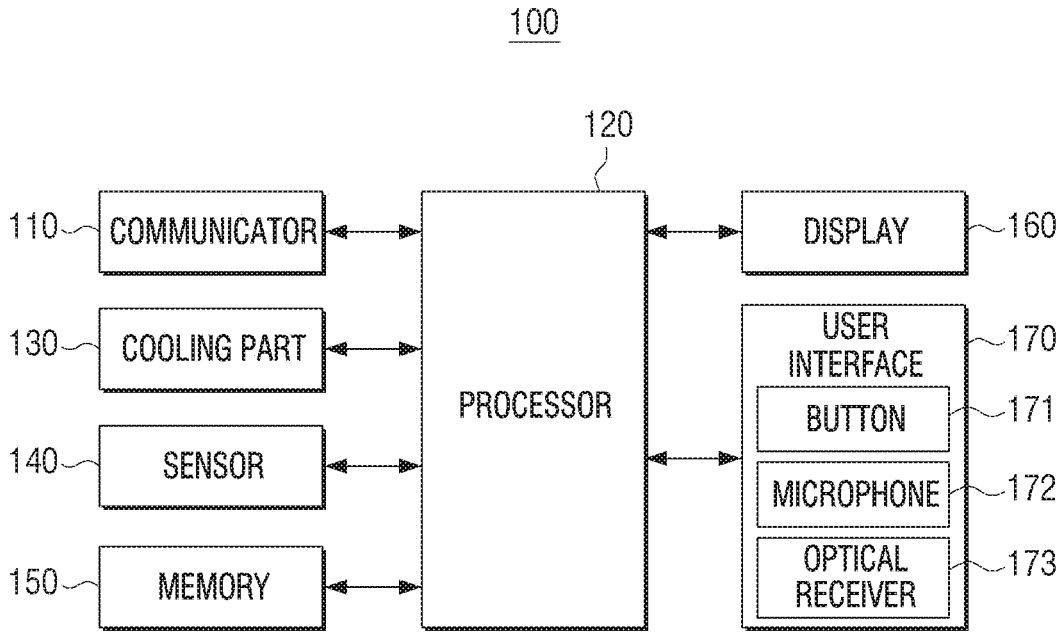
FIG. 3 is a block diagram illustrating a specific configuration of the air conditioning apparatus of FIG. 2.

FIG. 3 is a block diagram illustrating a specific configuration of the air conditioning apparatus of FIG. 2.

Referring to FIG. 3, the air conditioning apparatus 100 may include the communicator 110, the processor 120, a cooling part 130, a sensor 140, a memory 150, a display 160, and a user interface 170.

Some operations of the communicator 110 and the processor 120 are the same as the configurations of FIG. 2 and an overlapped description will be omitted.

The cooling part 130 is configured to discharged temperature-controlled air to condition indoor air. The cooling part 130 may include an indoor heat exchanger, an expansion valve, an air-blowing fan, or the like.

The indoor heat exchanger may exchange heat with the air introduced into the air conditioning apparatus 100 and the refrigerant provided from the outdoor unit. Specifically, the indoor heat exchanger may serve as an evaporator in cooling. That is, the indoor heat exchanger can absorb latent heat from the air introduced into the air conditioning apparatus 100 required for the phase transition for the refrigerant under the low-pressure, low-temperature and fog state to evaporate to gas. Conversely, the indoor heat exchanger may serve as a condenser in heating. That is, when the flow of the refrigerant is reversed as opposed to cooling, the heat of the refrigerant passing through the indoor heat exchanger may be released into the air introduced to the air conditioning apparatus 100.

The expansion valve may control the pressure of the refrigerant. Specifically, the expansion valve can lower the pressure by expanding the high-pressure low-temperature refrigerant passing through the outdoor heat exchanger when cooling. In addition, the amount of refrigerant introduced into the indoor heat exchanger may be adjusted. Conversely, the expansion valve can lower the pressure by expanding the low-pressure high-temperature refrigerant before delivering the refrigerant passing through the indoor heat exchanger to the outdoor heat exchanger during heating. In addition, the amount of refrigerant introduced into the outdoor heat exchanger can be adjusted.

The air blowing fan may introduce the external air into the air conditioning apparatus 100 and may discharge air of which temperature becomes different by heat exchange to the outside of the air conditioning apparatus 100.

The cooling part 130 may adjust the temperature of air, intensity of wind, or the like, released to the indoor space according to the control of the processor 120.

Meanwhile, although the configuration for controlling the temperature of the air is referred to as the cooling part 130 for convenience, the configuration is not limited to cooling, and at least one air conditioning such as heating for increasing the temperature of the indoor air, air blowing for forming an air current indoor, and a dehumidification for lowering indoor humidity, or the like.

The sensor 140 may sense the indoor temperature. Specifically, the sensor 140 can sense the temperature of a space in which the air conditioning apparatus 100 is disposed using a temperature sensor. The processor 120 may store information on the sensed temperature in the memory 150. In particular, the processor 120 may store information about the sensed temperature of the indoor space in the memory 150 while the air conditioning apparatus 100 is operating in a sleep cooling mode.

The memory 150 may store various programs and data necessary for the operation of the air conditioning apparatus 100. Specifically, at least one instruction may be stored in the memory 150. The processor 120 may perform the operations described above by executing instructions stored in the memory 150. The memory 150 may be implemented as a non-volatile memory, a volatile memory, a flash memory, a hard disk drive (HDD), or a solid state drive (SSD).

In addition, log data of the air conditioning apparatus 100 may be stored in the memory 150. The memory 150 may store user sleep information received from an external server or a control command based thereon.

The display 160 provided on an external surface of the air conditioning apparatus 100 is configured to display data. The display 160 may be implemented as various types of displays such as a liquid crystal display (LCD), organic light emitting diodes (OLED) display, a plasma display panel (PDP), and the like. A driving circuit of the display panel can be implemented using one or more of an a-Si thin film transistor (TFT), a low temperature poly silicon (LTPS) TFT, an organic TFT (OTFT), and a backlight. Further, the display 160 may be implemented as a flexible display.

According to various embodiments, the display 160 may not be provided in the air conditioning apparatus 100.

The user interface 170 is configured to receive a user's interaction, such as the manipulation of a user. Specifically, the user interface 170 may receive a manipulation command for setting the mode of the air conditioning apparatus 100 and controlling the temperature of the air conditioning apparatus 100 from a user.

The user interface 170 may include a button 171 formed in an arbitrary region, such as a front portion, a side portion, a rear portion, or the like, of the main body of the air conditioning apparatus 100, a microphone 172 for receiving a user's voice, an optical receiver 173 for receiving an optical signal corresponding to a user input (e.g., a touch, a press, a touch gesture, a voice, or a motion) from a remote control device, and the like. If the display 160 is a touch screen, the display 160 can also operate as the user interface 170.

Although not shown in FIG. 3, according to an embodiment, the air conditioning apparatus 100 may further include various external input ports for connecting to various external terminals such as a USB port, a LAN, etc. capable of connecting a USB connector to the air conditioning apparatus 100, a speaker for outputting sound, or the like.

Figure 4:
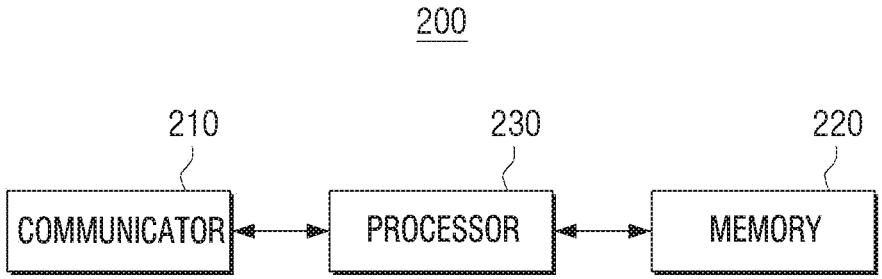
FIG. 4 is a block diagram illustrating a configuration of a server according to an embodiment.

FIG. 4 is a block diagram illustrating a configuration of a server according to an embodiment.

Referring to FIG. 4, the server 200 may include a communicator 210, a memory 220, and a processor 230. The server 200 may communicate with the air conditioning apparatus through the communicator 210, receive data from the air conditioning apparatus, perform data processing, and transmit the processed data to the air conditioning apparatus.

The communicator 210 may communicate with the air conditioning apparatus. Specifically, the communicator 210 can receive the usage log data of the air conditioning apparatus from the air conditioning apparatus. In particular, the usage log data may include data for a time at which the air conditioning apparatus is operated in a sleep cooling mode, and data for a set temperature.

The communicator 210 may communicate with an external server providing external environment information. For example, the communicator 210 may receive weather information according to a date and time from an external server providing weather information.

In another embodiment, the communicator 210 is capable of communicating with the wearable device in contact with the body of the user. Specifically, the wearable device may sense a bio-signal of the user, and the communicator 210 can receive data for the sensed bio-signal.

The communicator 210 may transmit the user sleep information obtained by the processor 230 to the air conditioning apparatus. Here, the user sleep information may be obtained based on the received data. For example, the user sleep information may include a user's sleep time, a wake-up time, a tendency temperature during sleep, or the like. Alternatively, the user sleep information may include information on a set temperature in operation in a start point, an end point, and a sleep cooling mode of the sleep cooling mode of the air conditioning apparatus.

The communicator 210 may communicate with an external device by wired manner or wireless manner.

The communicator 210 may be connected to an external device in a wireless manner, such as a wireless LAN, a Bluetooth, or the like. In addition, the communicator 210 may be connected to an external device using Wi-Fi, Zigbee, or Infrared (IrDA). The communicator 210 may include a connection port in a wired manner.

The memory 220 may store various programs and data necessary for the operation of the server 200. Specifically, at least one instruction may be stored in the memory 220. The processor 230 may perform the operations described above by executing instructions stored in the memory 220.

The memory 220 may store log data of the air conditioning apparatus received from the air conditioning apparatus.

The memory 220 may be stored with an artificial intelligence model. The artificial intelligence model can predict user sleep information based on the received data. Specifically, the artificial intelligence model can predict user sleep information based on periodic characteristics of each time extracted from the received data.

This periodic characteristic can be extracted by the processor 230 through a TBATS model included in the artificial intelligence model. Here, the TBATS model is one of models for predicting data based on periodicity, uses a trigonometric function term to catch the seasonality, uses the Box-Cox transformation to catch heterogeneity, uses the ARMA error model to catch short-term dynamics, uses the trend term to catch the trend, and uses a seasonal term to catch seasonality. The term "seasonality" refers to a variation phenomenon that is regularly generated due to a climate, a holiday, a vacation, etc., and may be a meaning corresponding to a periodic characteristic. Using the TBATS model described above, more accurate prediction is possible using a small amount of data. In addition to the TBATS model, a similar BATS model or MTBATS model can also be used.

The memory 220 may store user sleep information obtained by an operation of the processor 230 or a control command based thereon.

The processor 230 may control overall operations and functions of the server 200.

The processor 230 may input data for the sleep cooling mode received from the air conditioning apparatus to the artificial intelligence model stored in the memory 220 to obtain user sleep information. Specifically, the processor 230 may extract a periodic characteristic according to a period of data for a time in which an air conditioning apparatus is operated in a sleep cooling mode through an artificial intelligence model, and obtain user sleep information by using the extracted periodic characteristic.

The periodic characteristic according to the period of time may indicate that the data about operating time of the air conditioning apparatus in the sleep cooling mode is analyzed, and the data is extracted based on at least one criterion with an hour as an essential element and a day and a month as selective elements from the data. For example, the periodic characteristic may be obtained with at least one of a time unit, day unit, and a month unit.

If there is an interval in which the air conditioning apparatus is not operating in a sleep cooling mode is longer than a predetermined value in the data with respect to the time during which the air conditioning apparatus operates in the sleep cooling mode, for more accurate prediction, the processor 230 may obtain user sleep information by using the data from which the data about the time when the apparatus is not operated in the sleep cooing mode is deleted and the artificial intelligence model.

For example, according to flow of time, the processor 230 may substitute the time at which the air conditioning apparatus is operated in a sleep cooling mode to 1, and substitute a time at which the air conditioning apparatus is not operated in a sleep cooling mode to 0, based on received log data. Here, if there is an interval during which the air conditioning apparatus is not operated in the sleep cooling mode for 24 hours or more, the processor 230 may input the data from which the interval is deleted into the artificial intelligence model to obtain user sleep information. Here, the 24-hour time as a reference for data deletion is only one embodiment, and is not limited thereto.

Meanwhile, the data received through the communicator 210 from the air conditioning apparatus may further include information on a set temperature, an indoor temperature, an indoor humidity, etc. when the air conditioning apparatus is operated in a sleep cooling mode. The processor 230 may predict a preferred temperature and humidity of the user based on the temperature, the humidity data received from the air conditioning apparatus, and the weather information received from the external server. The processor 230 may use the artificial intelligence model to predict a preferred temperature and humidity during sleep.

The processor 230 may transmit the obtained user sleep information to the air conditioning apparatus through the communicator 210. Here, the user sleep information may include information on the sleep time of the user and information on the temperature and humidity that the user prefers when the user is sleeping.

As described above, according to the disclosure, even if a user does not turn on/off a sleep cooling mode each time, a cooling mode is automatically executed by reflecting the temperature and humidity that the user prefers, so that the user's convenience can be improved.

Figure 5:
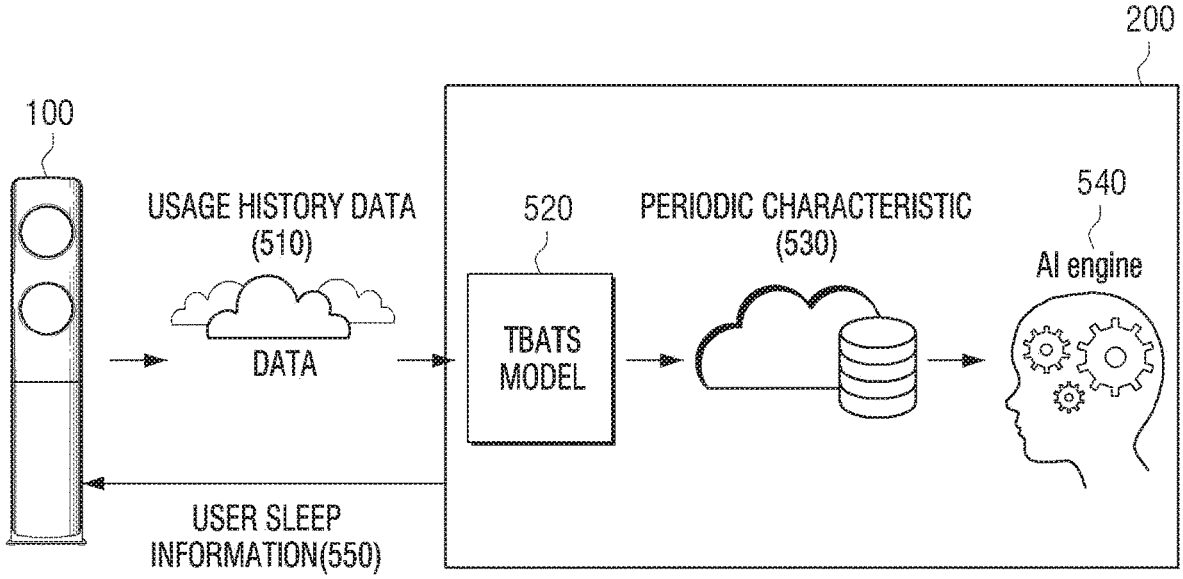
FIG. 5 is a diagram illustrating a data processing process.

FIG. 5 is a diagram illustrating a data processing process.

Referring to FIG. 5, the air conditioning apparatus 100 may transmit usage history data 510 to the server 200. The usage history data 510 may be data collected when the air conditioning apparatus 100 is in a normal mode operated by a user's manipulation.

For example, usage history data 510 may be as follows. Here, the usage history data 510 may refer to a time at which the air conditioning apparatus 100 is operated in a sleep cooling mode.

2018.04.01 20:00 for 4 hours (08 pm-12 am)
2018.04.02 22:00 for 2 hours (10 pm-12 am)
2018.04.09 19:00 for 7 hours (07 pm-02 am)
2018.04.22 22:00 for 4 hours (10 pm-02 am)
2018.04.23 19:00 for 5 hours (07 pm-12 am)

The server 200 may input the received usage history data 510 to a TBATS model 520 to obtain the periodic characteristic 530 of the data. Here, the periodic characteristic 530 may mean the periodic characteristic extracted according to the period of the usage history data 510 input to the TBATS model 520. For example, the periodic characteristic 530 may include various periodic characteristics in units of time, day, month. In addition, the TBATS model 520 may obtain the user's sleep information 550 based on the periodic characteristic 530. The artificial intelligence model 540 can learn a parameter of the TBATS model 520 by comparing obtained user sleep information 550 with actual user sleep information. Further, the server 200 can transmit the obtained user sleep information 550 to the air conditioning apparatus 100.

Here, the user sleep information 550 may include a sleep time according to the user's sleep tendency, and a wake-up time. The user sleep information 550 may include a control command for turning on/off the sleep cooling mode of the air conditioning apparatus 100 based on the predicted sleep time and the wake-up time of the user.

Figure 6:
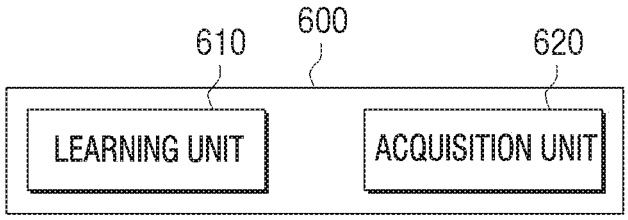
FIG. 6 is a block diagram illustrating a configuration of an electronic device for learning and using an artificial intelligence model according to an embodiment.

FIG. 6 is a block diagram illustrating a configuration of a server for learning and using an artificial intelligence model according to an embodiment.

Referring to FIG. 6, a processor 600 may include at least one of a learning unit 610 or an acquisition unit 620. The processor 600 of FIG. 6 may correspond to the processor 230 of the server 200 of FIG. 4 or a processor of a data learning server (not shown).

The learning unit 610 may generate or train a model for predicting the user's sleep information. The learning unit 610 may generate an artificial intelligence model for predicting user sleep information using the collected learning data. The learning unit 610 may use the collected learning data to generate a trained model having a reference for predicting user sleep information. The learning unit 610 may correspond to a training set of the artificial intelligence model.

For example, the learning unit 610 may generate, train, or update a model for predicting the sleep time of the user by using the data for the time at which the air conditioning apparatus is operated in the sleep cooling mode as input data. Specifically, the learning unit 610 can generate, train, or update a model for predicting user sleep information by using periodic characteristics for each period extracted from the data about the time in which the air conditioning apparatus is operated in a sleep cooling mode. In addition, the learning unit 610 can train or update the model so that the predicted user sleep information and the actual user sleep schedule match with each other. For example, when the air conditioning apparatus is operated on the basis of the predicted user sleep information, the learning unit 610 can train or update the model by further reflecting the data about the input operation command when an operation command of the user is input.

The acquisition unit 620 may obtain various information by using predetermined data as input data of the trained model.

For example, the acquisition unit 620 may obtain (or recognize, estimate, infer) information about the user's sleep tendency by using the data for the time at which the air conditioning apparatus is operated in the sleep cooling mode as input data. The acquisition unit 620 may obtain the start time, the operation time, the end time, and the like of the sleep cooling mode by using the information on the sleep tendency of the user.

It has been described that only information about the sleep time of the user is included in the user sleep information, but in actual implementation, the air conditioning apparatus can learn and obtain even the temperature and humidity that the user prefers when operating in a sleep cooling mode.

At least a portion of the learning unit 610 and at least a portion of the acquisition unit 620 may be implemented as software modules and/or at least one hardware chip form and mounted in an electronic apparatus. For example, at least one of the learning unit 610 and the acquisition unit 620 may be manufactured in the form of an exclusive-use hardware chip for AI, or a conventional general purpose processor (e.g., a CPU or an application processor) or a graphics-only processor (e.g., a GPU) and may be mounted on various electronic devices described above. The exclusive-use hardware chip for AI may, for example, and without limitation, include a dedicated processor for probability calculation, and it has higher parallel processing performance than existing general purpose processor, so it can quickly process computation tasks in AI such as machine learning. When the learning unit 610 and the acquisition unit 620 are implemented as a software module (or a program module including an instruction), the software module may be stored in a computer-readable non-transitory computer readable media. The software module may be provided by an operating system (OS) or by a predetermined application. Some of the software modules may be provided by an OS, and some of the software modules may be provided by a predetermined application.

The learning unit 610 and the acquisition unit 620 may be mounted on one electronic apparatus, or may be mounted on separate electronic apparatuses, respectively. For example, one of the learning unit 610 and the acquisition unit 620 may be included in the air conditioning apparatus, and the other one may be included in an external server. In addition, the learning unit 610 and the acquisition unit 620 may provide the model information constructed by the learning unit 610 to the acquisition unit 620 via wired or wireless communication, and provide data which is input to the acquisition unit 620 to the learning unit 610 as additional data.

Figure 7:
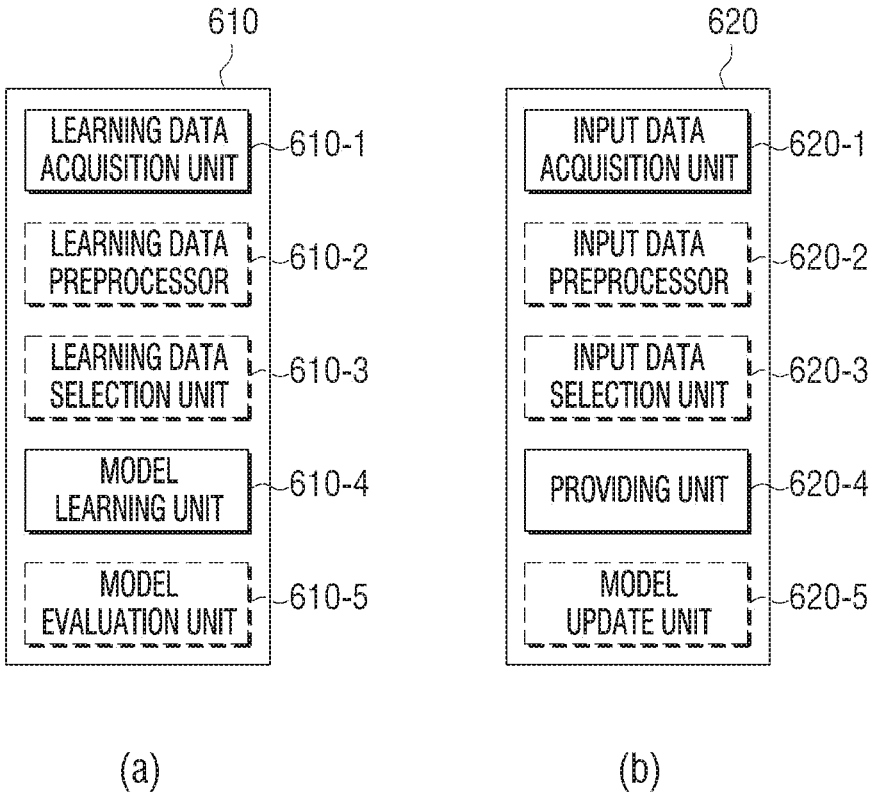
FIG. 7 is a block diagram illustrating a specific configuration of a learning unit and an acquisition unit according to an embodiment.

FIG. 7 is a block diagram illustrating a specific configuration of a learning unit and an acquisition unit according to an embodiment.

Referring to FIG. (a) of 7, the learning unit 610 according to some embodiments may implement a learning data acquisition unit 610-1 and a model learning unit 610-4. The learning unit 610 may further selectively implement at least one of a learning data preprocessor 610-2, a learning data selection unit 610-3, and a model evaluation unit 610-5.

The learning data acquisition unit 610-1 can obtain learning data necessary for the model. According to an embodiment, the learning data acquisition unit 610-1 can obtain data on a time when the air conditioning apparatus is operated in a sleep cooling mode, data for temperature and humidity when the air conditioning apparatus is operated in a sleep cooling mode, data for a set temperature when the air conditioning apparatus is operated in a sleep cooling mode, or the like, as learning data. Alternatively, if the period in which the air conditioning apparatus is not operating in the sleep cooling mode is greater than or equal to a predetermined value, the learning data acquisition unit 610-1 may delete the data for the corresponding interval and obtain the learning data.

The model learning unit 610-4 can train how to correct the difference between the sleep time, the wake-up time, the setting temperature, and the humidity of the user obtained by using the learning data, and the actual sleep information of the user. For example, the model learning unit 610-4 can train an artificial intelligence model through supervised learning of at least a part of the learning data. The model learning unit 610-4 may train, for example, by itself using learning data without specific guidance to make the artificial intelligence model learn through unsupervised learning which detects a criterion for determining a situation. The model learning unit 610-4 can train the artificial intelligence model through reinforcement learning using, for example, feedback on whether the result of determining a situation according to learning is correct. As an embodiment, the model learning unit 610-4 may also train the artificial intelligence model using, for example, a learning algorithm including an error back-propagation method or a gradient descent.

When the artificial intelligence model is trained, the model learning unit 610-4 can store the trained artificial intelligence model. In this case, the model learning unit 610-4 can store the trained artificial intelligence model in a server (e.g., artificial intelligence server). The model learning unit 610-4 may store the trained artificial intelligence model in a memory of a server or the air conditioning apparatus connected to the server via a wired or wireless network.

The learning data preprocessor 610-2 may, for example, preprocess acquired data so that the data obtained in the learning for predicting user's sleep information can be used. That is, the learning data preprocessor 610-2 can process the acquired data into a predetermined format so that the model acquisition unit 610-4 may use the acquired data for learning to predict user's sleep information.

The learning data selection unit 610-3 may, for example, select data required for learning from the data acquired by the learning data acquisition unit 610-1 or the data preprocessed by the learning data preprocessor 610-2. The selected learning data may be provided to the model learning unit 610-4. The learning data selection unit 610-3 can select learning data necessary for learning from the acquired or preprocessed data in accordance with a predetermined selection criterion. The learning data selection unit 610-3 may also select learning data according to a predetermined selection criterion by learning by the model learning unit 610-4.

The learning unit 610 may further implement the model evaluation unit 610-5 to improve a recognition result of the artificial intelligence model.

The model evaluation unit 610-5 may input evaluation data to the artificial intelligence model and enable the model learning unit 610-4 to learn again if the recognition result output from the evaluation data does not satisfy a predetermined criterion. In this case, the evaluation data may be pre-defined data for evaluating the artificial intelligence model.

For example, the model evaluation unit 610-5 may evaluate, among the recognition results of the trained artificial intelligence model with respect to the evaluation data, that a predetermined criterion has not been satisfied if the number or ratio of the evaluation data in which the recognition result is not accurate exceeds a preset threshold.

When there are a plurality of trained artificial intelligence models, the model evaluation unit 610-5 may evaluate whether each learned artificial intelligence model satisfies a predetermined criterion, and determine the model which satisfies a predetermined criterion as a final artificial intelligence model. When there are a plurality of models that satisfy a predetermined criterion, the model evaluation unit 610-5 may determine one or a predetermined number of models which are set in an order of higher evaluation score as a final artificial intelligence model.

Figure 8:
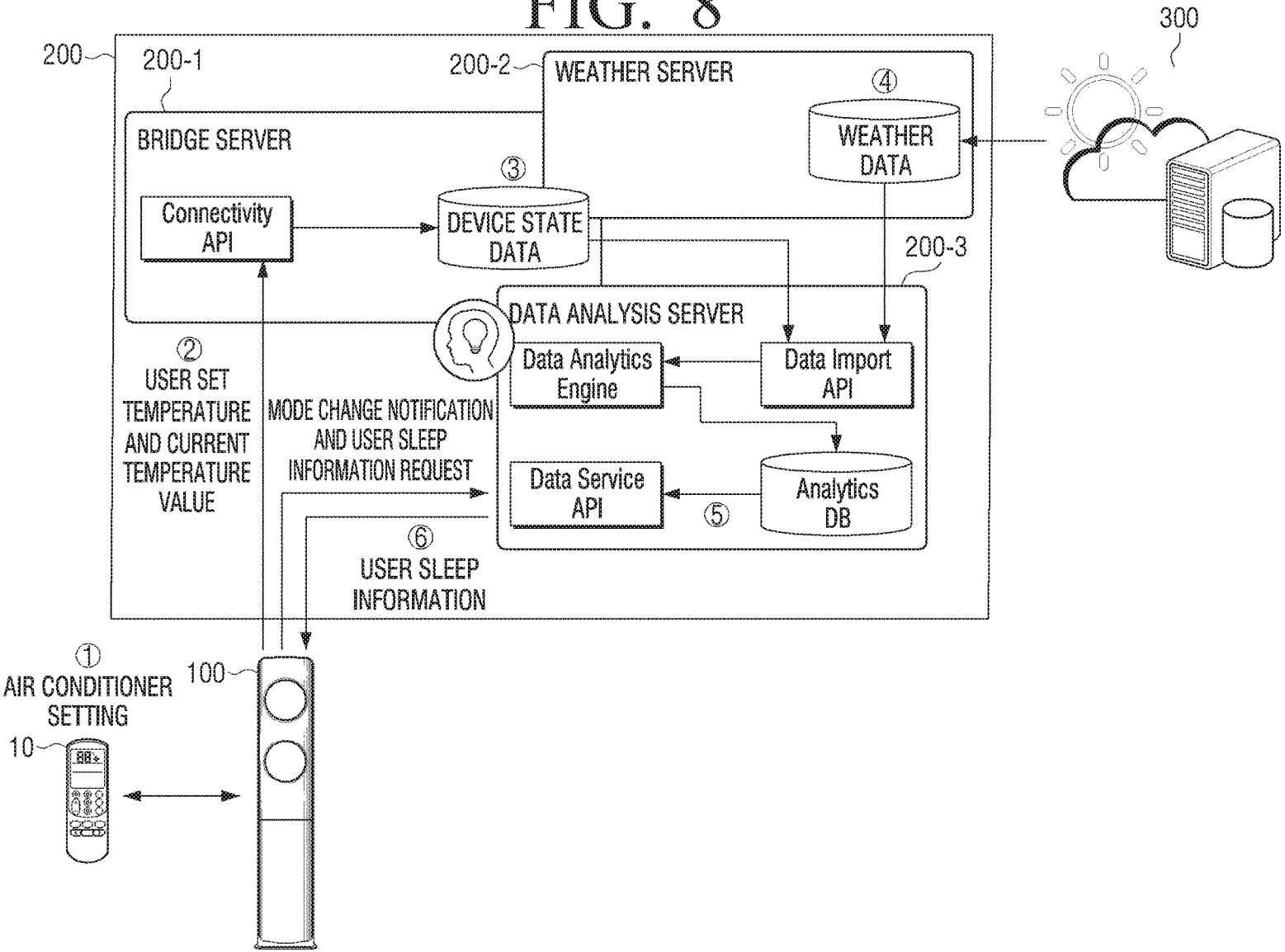
FIG. 8 is a diagram illustrating an air conditioning system according to another embodiment.

FIG. 8 is a diagram illustrating an air conditioning system according to another embodiment. Specifically, FIG. 8 illustrates an embodiment of predicting user sleep information in consideration of a user sleep time as well as a preferred temperature and humidity when the user is sleeping.

Referring to FIG. 8, a user can input a manipulation command to the air conditioning apparatus 100 through a remote control device 10 (①). Although a manipulation command is input to the air conditioning apparatus 100 through the remote control device 10 in FIG. 8, a manipulation command may be input to the air conditioning apparatus 100 through a button, a touch screen, or the like provided in the air conditioning apparatus 100. At this time, the air conditioning apparatus 100 may be set to a general mode operated by a user's setting.

The air conditioning apparatus 100 may perform an operation on the basis of the input manipulation command and transmit data corresponding to the manipulation command to the server 200. Specifically, the air conditioning apparatus 100 can transmit data about the temperature set by the user and current temperature sensed by the sensor to the server (②). Referring to FIG. 8, one air conditioning apparatus 100 is associated with the server 200, but in the actual implementation, two or more air conditioning apparatus 100 can be associated with the server 200, respectively, to transmit and receive data.

Here, the server 200 may include at least one server. Specifically, the server 200 may include a bridge server 200-1 for storing data received from the air conditioning apparatus 100, a weather server 200-2 for storing weather data from an external server 300 providing weather, a data analysis server 200-3 for predicting user sleep information by analyzing data of the air conditioning apparatus 100 and weather data, or the like. Referring to FIG. 8, the server 200 is configured as three servers, but in actual implementation, two or less servers or four or more servers may be configured according to the functions of each server.

The bridge server 200-1 may store data received from the air conditioning apparatus 100 as device state data. (③). Specifically, the bridge server 200-1 can store data about the temperature of the indoor space and the set temperature of user of the air conditioning apparatus 100 in a time-series manner. In addition, the data transmitted from the air conditioning apparatus 100 to the bridge server 200-1 may further include data about the start time, the end point, and time during which the apparatus is operated in the sleep cooling mode.

The weather server 200-2 may receive weather data in accordance with weather and time from the external server 300 providing weather information and store the same (④).

The data analysis server 200-3 may obtain the user sleep information using the device state data stored in the bridge server 200-1 and the weather data stored in the weather server 200-2 (⑤). Specifically, the data analysis server 200-3 can predict the user's sleep information using the stored artificial intelligence model. Here, the user sleep information may include information on the user's sleep time, wake-up time, preferred temperature and humidity during sleeping, or the like. For example, the data analysis server 200-3 may obtain user sleep information using a TBATS model or the like for predicting data using the periodicity of the data.

If the user changes the mode of the air conditioning apparatus 100 into an artificial intelligence mode which may be operated without user's manipulation from the normal mode, the air conditioning apparatus 100 can inform the server 200 of the change of the mode and request the user sleep information. When the server 200 receives the request about the user sleep information from the air conditioning apparatus 100, the server 200 can transmit information about the user's sleep time, the preferred temperature and humidity during sleeping to the air conditioning apparatus 100 (⑥). The server 200 may transmit the time-series control command of the air conditioning apparatus 100 corresponding to the user sleep information to the air conditioning apparatus 100.

Figure 9:
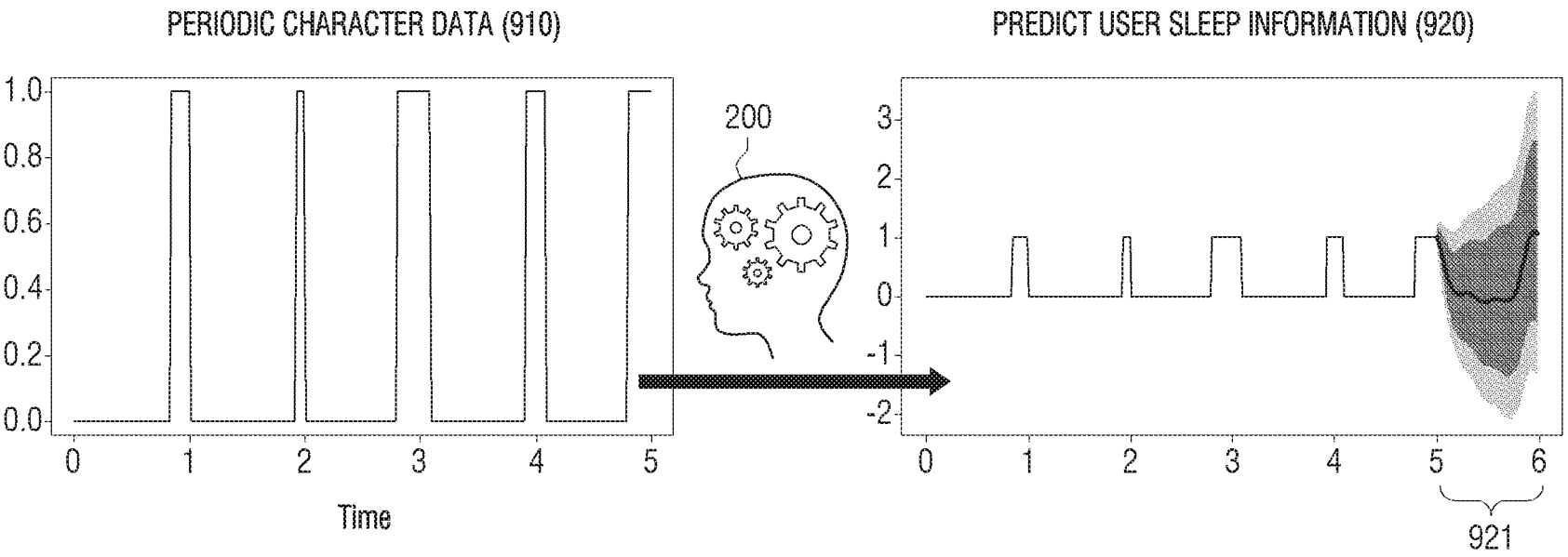
FIG. 9 is a diagram illustrating user sleep information obtained according to an embodiment.

FIG. 9 is a diagram illustrating user sleep information obtained according to an embodiment.

Referring to FIG. 9, the server 200 may predict user sleep information 920 using periodic characteristic data 910. Here, the periodic characteristic data 910 may be extracted from the data for the time at which the air conditioning apparatus is operated in a sleep cooling mode.

For example, when the usage history data of the dive days as illustrated in FIG. 5 is transmitted to the server 200, the server 200 may substitute the time at which the air conditioning apparatus is operated in the sleep cooling mode to 1, and substitute the time at which the sleep cooling mode is not operated to 0, for substitution to time-series data. In order to more clearly show the periodic characteristic, the server 200 may delete an interval which is 1 for greater than or equal to a predetermined period to obtain the periodic characteristic data 910.

The server 200 may input the acquired periodic characteristic data 910 to the artificial intelligence model to predict the user sleep information 920. At this time, the artificial intelligence model can predict information about user sleep time by using a TBATS model or the like for predicting data using a periodic characteristic.

Referring to the predicted user sleep information 920, it can be identified that user sleep information 921 on the sixth day has been predicted based on the periodic characteristic data of five days. A dark gray area indicated with predicted user sleep information 921 of the sixth day is a prediction interval of a confidence level of 85%, and a soft gray area may be a prediction interval of a confidence level of 90%.

According to the disclosure, more accurate data can be predicted based on data of a small amount of at least five days.

Figure 10:
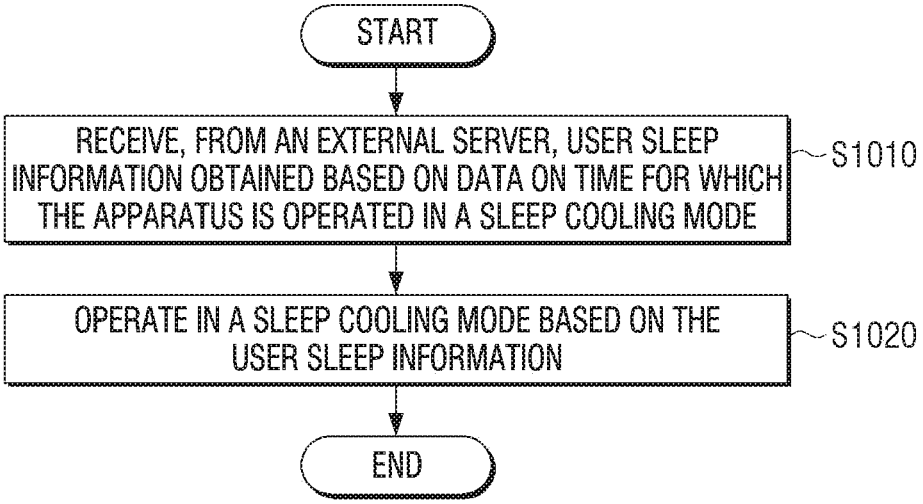
FIG. 10 is a flow chart schematically illustrating a controlling method of an air conditioning apparatus according to an embodiment.

FIG. 10 is a flow chart schematically illustrating a controlling method of an air conditioning apparatus according to an embodiment.

Referring to FIG. 10, the air conditioning apparatus may receive user sleep information obtained from an external server based on data about time operated in a sleep cooling mode in operation S1010. Specifically, the data about the time at which the air conditioning apparatus is operated in the sleep cooling mode may be the data collected when the air conditioning apparatus is set to the normal mode operated by the user's manipulation. When the air conditioning apparatus transmits the collected data to an external server, the external server can obtain user sleep information based on the sleep tendency of the user based on the collected data. At this time, the external server may extract a periodic characteristic of the data, and obtain user sleep information by using the extracted periodic characteristic and the artificial intelligence model. As the external server transmits the obtained user sleep information to the air conditioning apparatus, the air conditioning apparatus may receive the user sleep information.

The air conditioning apparatus may operate in a sleep cooling mode based on the received user sleep information in operation S1020. Specifically, the air conditioning apparatus may operate in a sleep cooling mode based on a sleep time, a wake-up time, or the like, of a user included in the user sleep information. The user sleep information may further include temperature information, humidity information, or the like, preferred by the user during sleeping, and the air conditioning apparatus may further reflect the temperature and humidity information and operate in a sleeping cooling mode.

Figure 11:
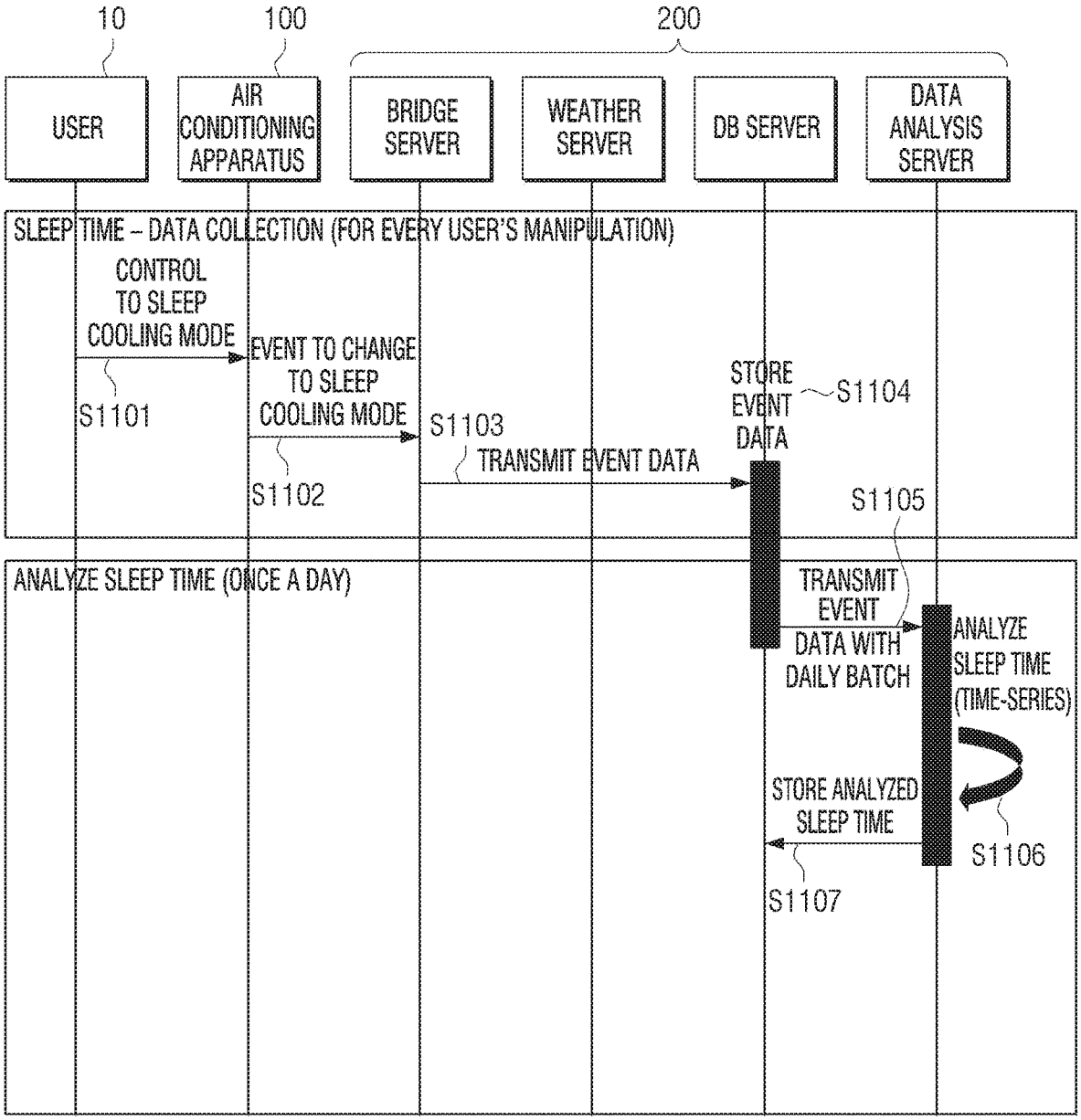
FIG. 11 is a flowchart illustrating a process of collecting data on time for which the air conditioning apparatus is operated in a sleep cooing mode according to an embodiment.

FIG. 11 is a flowchart illustrating a process of collecting data on time for which the air conditioning apparatus is operated in a sleep cooing mode according to an embodiment.

First, the user 10 may input a manipulation command to control the air conditioning apparatus 100 in a cooling mode in operation S1101. In this case, the air conditioning apparatus 100 may be set to a general mode operated under the control of a user.

The air conditioning apparatus 100 may transmit, to the server 200, an event indicating that the air conditioning apparatus 100 has changed to the sleep cooling mode according to the user's manipulation command input in operation S1102. Specifically, the server 200 may be configured as at least one server and may include a bridge server, a weather server, and a data analysis server, as shown in FIG. 8. Referring to FIG. 11, a database server is shown as a separate server for illustrative purposes of an operation of storing data, but the server may be a part of a bridge server, a weather server, and a data analysis server. In addition, each server is distinguished by functions for convenience, and all or a part of each function may be performed in one or more servers.

The bridge server may transmit the data for the event to the DB server when the bridge server receives the sleep cooling mode change event in operation S1103. The DB server may store the received event data in operation S1104. The event data may be data for a time to turn on or off the sleep cooling mode.

The server 200 may collect data about time at which the air conditioning apparatus 100 operates in a sleep cooling mode through the above process whenever the user manipulates the apparatus in a sleep cooling mode.

The server 200 may analyze the sleep time of the user based on the collected data. Specifically, the DB server may transmit the event data of a daily batch to the data analysis server in operation S1105, and the data analysis server can analyze the sleep time of the user based on the collected data in operation S1106. The sleep time of the user can be analyzed in a time series manner Specifically, the data analysis server may analyze the sleep time of the user, e.g., bedtime, wake-up time, etc., using the artificial intelligence model.

The data analysis server may transmit the analyzed sleep time to the DB server and store the same in operation S1107.

The server 200 may repeat the above process every day and analyze the user's sleep time based on the operating time in the sleep cooing mode.

Figure 12:
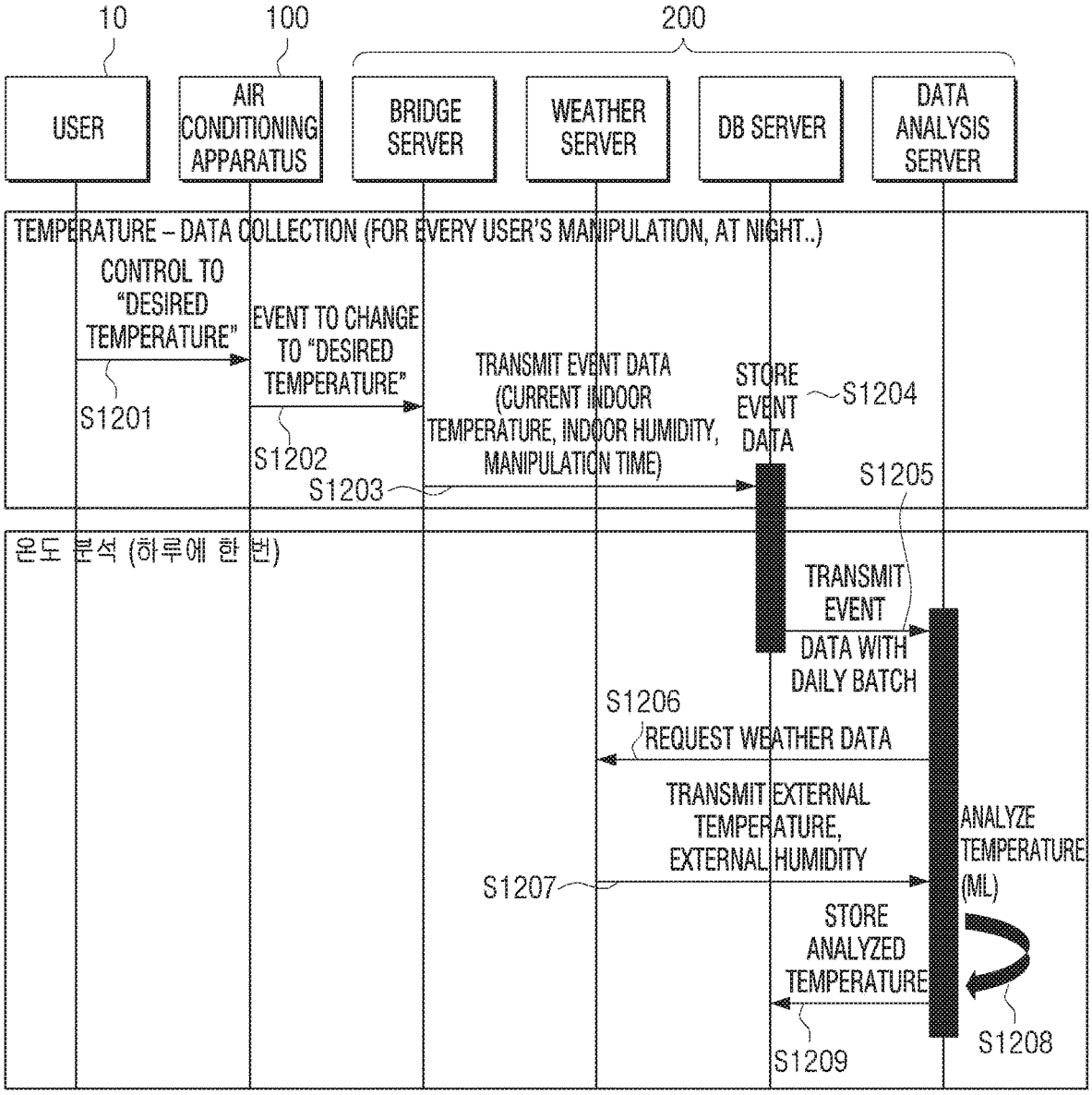
FIG. 12 is a flowchart illustrating a process of collecting data for a set temperature according to an embodiment; and, FIG. 13 is a flowchart illustrating an operation in an artificial intelligence mode according to an embodiment.

FIG. 12 is a flowchart illustrating a process of collecting data for a set temperature according to an embodiment.

The user 10 may input a manipulation command for controlling the air conditioning apparatus 100 to a desired temperature in operation S1201. In this case, the air conditioning apparatus 100 may be set to a general mode operated under the control of a user.

The air conditioning apparatus 100 may transmit, to the server 200, an event indicating that the desired temperature is changed according to the manipulation command of the user in operation S1202.

Specifically, the server 200 may be configured as at least one server and may include a bridge server, a weather server, and a data analysis server, as shown in FIG. 8. Referring to FIG. 12, a database (DB) server is shown as a separate server in order to describe an operation in which data is stored, but the configuration may be part of a bridge server, a weather server, and a data analysis server. In addition, each server is divided based on a plurality of functions for convenience, and all or a part of each function may be performed in one or more servers.

If the bridge server receives the desired temperature change event, the bridge server can transmit data for the event to the DB server in operation S1203. Specifically, the information about the event may be an indoor temperature, an indoor humidity, a manipulation time, or the like, when a manipulation command for changing a desired temperature is input. In particular, when the desired temperature is changed while the air conditioning apparatus is operated in a cooling mode, data for the desired temperature may also be included.

The DB server may store the received event data in operation S1204.

The server 200 can collect data about time, temperature, humidity, etc. when the air conditioning apparatus 100 changes the desired temperature through the above-described process whenever the user operates to change the desired temperature.

In addition, the server 200 may analyze the tendency of the user based on the collected data. Specifically, the DB server can transmit the event data of a daily batch to the data analysis server in operation S1205. At this time, the data analysis server may request weather data to the weather server in operation S1206. Accordingly, the weather server can transmit information on the external temperature and the external humidity to the data analysis server in operation S1207.

The data analysis server may analyze the tendency of the user based on the collected data in operation S1208. Here, the tendency of the user may include the temperature and humidity that the user prefers according to the weather, the temperature and humidity that the user prefers, and the like. The data analysis server can analyze the tendency of a user by using artificial intelligence model which is trained through machine learning (ML).

The data analysis server may transmit and store the analyzed user preference temperature to the DB server in operation S1209. At this time, the user's preferred temperature is dependent on the external temperature and humidity, and information on the external temperature and the external humidity can be transmitted to the DB server together with the information on the external temperature and humidity, and stored.

The server 200 may repeat the above process every data and analyze the user's tendency including the temperature preferred by the user.

Figure 13:
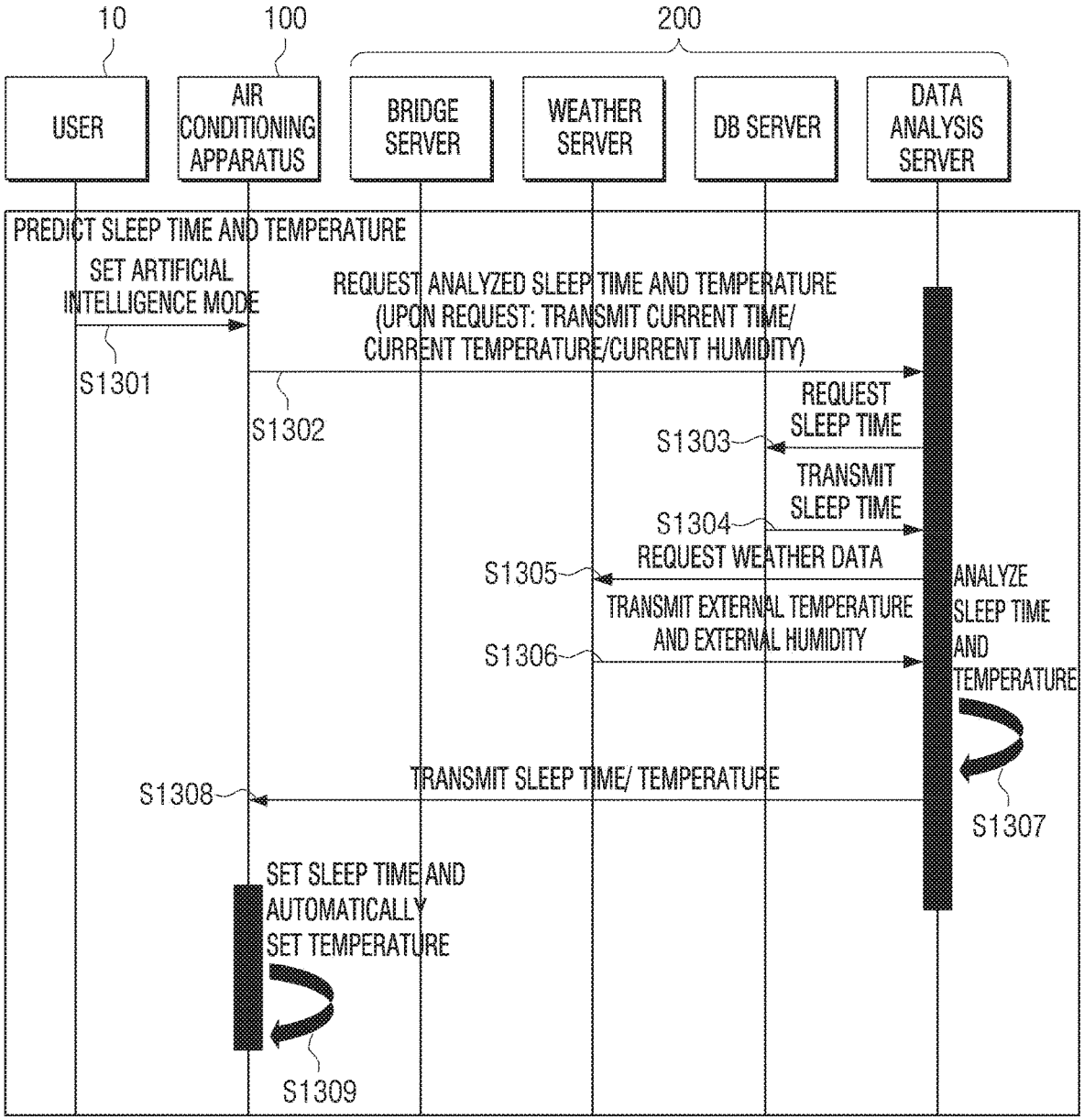

FIG. 13 is a flowchart illustrating an operation in an artificial intelligence mode according to an embodiment.

First, the user 10 may input a manipulation command for changing the mode of the air conditioning apparatus 100 into the artificial intelligence mode in operation S1301. Here, the artificial intelligence mode can be a mode in which the air conditioning apparatus 100 is automatically operated without a user's manipulation.

The air conditioning apparatus 100 may request the server 200 with the analyzed sleep time and temperature as the mode is set to the artificial intelligence mode in operation S1302. At this time, the air conditioning apparatus 100 may transmit a request for the analyzed user sleep time and temperature, and transmit information on the current time, the current temperature, and the current humidity together.

When receiving a request for user sleeping information from the air conditioning apparatus 100, the data analysis server may request the analyzed sleep time to the DB server in operation S1303, and can receive the analyzed sleep time from the DB server in operation S1304.

The data analysis server may request information about the current weather at the weather server in operation S1305, and may receive information about the current weather including the external temperature and the external humidity in operation S1306.

The data analysis server can analyze the sleep time and the preferred temperature of the user based on information on the user sleep time received from the DB server and information on the current weather received from the weather server in operation S1307.

The data analysis server may transmit information on the analyzed sleep time and temperature to the air conditioning apparatus 100. Here, the analyzed sleep time may include a user's bedtime, a wake-up time, etc., and information on the temperature may include information about a preferred temperature and humidity when the user at bedtime.

The air conditioning apparatus 100 may automatically operate the sleep cooling mode based on the sleep time and the set temperature received from the server 200, and set a desired temperature in operation S1309.

According to the various embodiments described above, the air conditioning apparatus can automatically operate in a sleeping cooling mode based on the analyzed sleep information of the user even if the user does not set the sleep cooling mode every time before bedtime, and can provide a more pleasant environment while sleeping by setting the temperature and humidity that the user prefers according to the external temperature and humidity.

The various example embodiments described above may be implemented in software, hardware, or the combination of software and hardware. By hardware implementation, the example embodiments of the disclosure may be implemented using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, or electric units for performing other functions. In some cases, example embodiments described herein may be implemented by the processor 120 itself. According to a software implementation, example embodiments of the disclosure, such as the procedures and functions described herein may be implemented with separate software modules. Each of the above-described software modules may perform one or more of the functions and operations described herein.

The method according to the various example embodiments may be stored in a non-transitory readable medium. The non-transitory readable medium may be loaded in various devices and used.

The non-transitory computer readable medium may refer, for example, to a medium that stores data semi-permanently, and is readable by an apparatus. For example, the aforementioned various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like.

According to example embodiments of the disclosure, a method disclosed herein may be provided in a computer program product. A computer program product may be traded between a seller and a purchaser as a commodity. A computer program product may be distributed in the form of a machine-readable storage medium (e.g., a compact disc (CD)-ROM) or distributed online through an application store (e.g., PlayStore™). In the case of on-line distribution, at least a portion of the computer program product may be stored temporarily or at least temporarily in a storage medium, such as a manufacturer's server, a server in an application store, a memory in a relay server, and the like.

While the disclosure has been shown and described with reference to various example embodiments, it will be understood by those skilled in the art that various changes in form and details may be made therein without departing from the spirit and scope of the disclosure as defined by the appended claims and their equivalents.

What is claimed is:

1. A method for controlling an air conditioning apparatus, the method comprising:

receiving, from an external server, user sleep information obtained based on data on time for which the air conditioning apparatus is operated in a sleep cooling mode used during a user's sleep; and operating in the sleep cooling mode based on the user sleep information, wherein the user sleep information is obtained by using an artificial intelligence model included in the external server and the data, wherein the artificial intelligence model is learned for predicting the user sleep information by using a periodic characteristic over time of the data, wherein the periodic characteristic over the time is extracted based on at least one criteria with an hour as an essential element, and a day and a month as selective elements from the data, and wherein, based on an interval where time for which the air conditioning apparatus is not operated in the sleep cooling mode is greater than or equal to a preset value, the artificial intelligence model is learned by using data from which the data of a corresponding interval is deleted.

2. The method of claim 1, wherein the air conditioning apparatus is set to one of a general mode operated by a user's manipulation or an artificial intelligence model operated based on a user's usage history without a user's manipulation, and the method further comprising:

while the air conditioning apparatus is being set to a general mode, transmitting, to the external server, data on time for which the air conditioning apparatus is operated in the sleep cooling mode by the user's manipulation.

3. The method of claim 2, wherein the receiving comprises receiving the user sleep information while the air conditioning apparatus is set to an artificial intelligence mode, and wherein the operating comprises operating in the sleep cooling mode, while the air conditioning apparatus is set to an artificial intelligence mode.

4. The method of claim 1, wherein the artificial intelligence model comprises a Trigonometric Regressors, Box-Cox transformation, ARMA Error, Trend and Seasonality (TBATS) model, and wherein the user sleep information is obtained based on a periodic characteristic extracted using the TBATS model.

5. The method of claim 1, wherein the user sleep information comprises at least one of a start point in time, an operation time, and end point in time of the sleep cooling mode.

6. The method of claim 1, wherein the user sleep information further comprises setting information of the sleep cooling mode, and wherein the operating comprises operating in the sleep cooling mode based on a set temperature.

7. An air conditioning apparatus comprising:

a communicator configured to communicate with an external server; and a processor configured to cause the air conditioning apparatus to receive, through the communicator, user sleep information obtained based on data on time for which the air conditioning apparatus is operated in a sleep cooling mode used during a user's sleep, and operates in the sleep cooling mode based on the user sleep information, wherein the user sleep information is obtained by using an artificial intelligence model included in the external server and the data, wherein the artificial intelligence model is learned for predicting the user sleep information by using a periodic characteristic over time of the data, wherein the periodic characteristic over the time is extracted based on at least one criteria with an hour as an essential element, and a day and a month as selective elements from the data, and wherein, based on an interval where time for which the air conditioning apparatus is not operated in the sleep cooling mode is greater than or equal to a preset value, the artificial intelligence model is learned by using data from which the data of a corresponding interval is deleted.

8. The air conditioning apparatus of claim 7, wherein the air conditioning apparatus is set to one of a general mode operated by a user's manipulation or an artificial intelligence model operated based on a user's usage history without a user's manipulation, and wherein the processor is further configured to, while the air conditioning apparatus is being set to a general mode, transmit, to the external server, data on time for which the air conditioning apparatus is operated in the sleep cooling mode by the user's manipulation.

9. The air conditioning apparatus of claim 8, wherein the processor is further configured to receive the user sleep information while the air conditioning apparatus is set to an artificial intelligence mode, and operate in the sleep cooling mode, while the air conditioning apparatus is set to an artificial intelligence mode.

10. The air conditioning apparatus of claim 7, wherein the artificial intelligence model comprises a Trigonometric Regressors, Box-Cox transformation, ARMA Error, Trend and Seasonality (TBATS) model, and wherein the user sleep information is obtained based on a periodic characteristic extracted using the TBATS model.

* * * * *